US009225128B2

(12) United States Patent
Yap

(10) Patent No.: US 9,225,128 B2
(45) Date of Patent: Dec. 29, 2015

(54) EXTENSION SOCKET WITH CORD STORAGE AND DISPENSING SYSTEM

(76) Inventor: Wang Han Yap, Tampin (MY)

( * ) Notice: Subject to any disclaimer, the term of this patent is extended or adjusted under 35 U.S.C. 154(b) by 633 days.

(21) Appl. No.: 13/512,171

(22) PCT Filed: Nov. 25, 2009

(86) PCT No.: PCT/MY2009/000199

§ 371 (c)(1),
(2), (4) Date: May 25, 2012

(87) PCT Pub. No.: WO2010/041925

PCT Pub. Date: Apr. 15, 2010

(65) Prior Publication Data

US 2013/0023148 A1 Jan. 24, 2013

(51) Int. Cl.
*H01R 13/72* (2006.01)
*H01R 25/00* (2006.01)

(52) U.S. Cl.
CPC ..... *H01R 13/72* (2013.01); *H01R 25/003* (2013.01)

(58) Field of Classification Search
USPC ..... 439/650–652, 501, 4; 191/12.4
IPC ..... H01R 13/72,13/60, 13/64; H02G 11/02
See application file for complete search history.

(56) References Cited

U.S. PATENT DOCUMENTS

| | | | | |
|---|---|---|---|---|
| 4,656,320 | A * | 4/1987 | Maddock | 191/12.4 |
| 5,924,892 | A * | 7/1999 | Ferracina | 439/501 |
| 6,077,109 | A * | 6/2000 | Prazoff | 439/501 |
| 6,454,609 | B1 * | 9/2002 | Huang | 439/652 |
| 6,793,523 | B1 * | 9/2004 | Wei | 439/501 |
| 6,940,015 | B2 * | 9/2005 | Fang | 174/53 |
| 7,114,603 | B2 * | 10/2006 | Lai | 191/12.4 |
| 7,399,199 | B2 * | 7/2008 | Symons | 439/501 |

* cited by examiner

*Primary Examiner* — Hien Vu
(74) *Attorney, Agent, or Firm* — Bacon & Thomas, PLLC

(57) ABSTRACT

Extension socket (8) with cord storage and dispensing system. Socket (8) comprises a housing (9) with upper housing (10) lower housing (20), a wiring and contact mechanisms lower housing (20) by which pins of a plug make electrical contacts with socket unit (18), an electrical plug (50) and cable cord (40) connecting the wiring and contact mechanisms within the housing (9) when upper housing (10) and lower housing (20) are coupled together, a receiving track (30) is formed between the walls of the upper housing; upper housing (10) has outlet port (36, 37) for cable cord (40) the bottom plate (21) of lower housing (20) has spaced apart projecting blocks with a passage (38 FIG. 4). Retainer (32) included to hold the cable cord in place in receiving track and/or the passage (38) between two adjacent projecting blocks (33).

18 Claims, 7 Drawing Sheets

EXTENSION SOCKET WITH CORD STORAGE AND DISPENSING SYSTEM

TECHNICAL FIELD

This invention relates generally to an extension socket, and particularly to an extension socket with cord storage and dispensing system.

BACKGROUND ART

An extension socket provides multiple socket units for more than one electrical appliance to share power source from a common wall socket or any extension socket. Prior art extension socket comprises a housing body with multiple socket units, an electrical plug, and an elongated extension cord connecting the plug and the housing body. The length of the extension cord is often left exposed and can be entangling or obstructing movements.

U.S. Pat. No. 6,142,405 discloses extension cord storage and dispensing system for conveniently storing and dispensing an elongated extension cord of various lengths without entanglement and without requiring unwrapping of the entire length of extension cord to effectively utilise both ends. The inventive device includes a first spool, a second spool and a handle. The two spools have preferably a flat profile for convenient storage. The first spool receives a shorter length of the cord that is commonly needed thereby separating the shorter length constantly dispensed and stored from the longer length. The main disadvantage of this invention is that it is a stand-alone device which is not directly connected to any electrical device. In actual application, it becomes an additional carrying item.

U.S. Pat. No. 6,077,109 discloses an extension socket, including a socket body which consists of more than one socket units electrically connected each other, an electrical plug, an extension wire having a predetermined length connecting between the socket units and the electrical plugs, and a receiver arrangement for receiving the extension wire. The socket body includes a socket housing to install the socket units therein. The socket housing has a top wall, a bottom wall and a surrounding side wall between the top wall and the bottom wall, wherein the extension wire is extended from a wire outlet of the surrounding side wall to the electrical plug. The receiver arrangement is composed of a ring shaped protecting wall which is arranged to surround the socket housing of the socket body and has a predetermined height, and a connecting wall extended from a top end of the protecting wall to the socket housing, wherein a receiving chamber is defined between the protective wall and the surrounding side wall of the socket housing. Thereby, the extension wire can be wound around the surrounding side wall of the socket housing within the receiving chamber. The main disadvantage of this invention is that a separate receiver arrangement surrounding the socket body is required. The holding arm is also not efficient.

SUMMARY OF INVENTION

It is an object of the present invention to provide an extension socket with cable cord storage and dispensing system that allows for much finer adjustment in the length of cable cord dispensable from the cable storage and dispensing system as compared to prior art, allowing more variation in the lengths of cable cord dispensable from the cord storage and dispensing system.

The extension socket of this invention comprises a housing with an upper housing and a lower housing, a set of wiring and contact mechanisms (not shown) in the working enclosure of the lower housing by which the pins of a plug make electrical contacts with the wiring and contact mechanisms of the socket unit (18), an electrical plug (50) and a cable cord (40) having a predetermined length connecting the wiring and contact mechanisms within the housing of the extension socket to the electrical plug, wherein when the upper housing and the lower housing are coupled and fastened together, a receiving track of predetermined width is confined between the walls of the upper housing and the intermediate wall of the lower housing for storage of cable cord; wherein the upper housing has at least one outlet port to enable the cable cord to be dispensed out from the receiving track from the outlet port and wherein the bottom plate of the lower housing has a plurality of spaced apart projecting blocks extending outward from the back of the bottom plate with a passage of predetermined width confined between the block walls of any two adjacent projecting blocks to receive half looping of the cable cord through a passage or the sidewinding through two or more passages for finer adjustment of the length of the cable cord to be dispensed out through the outlet port. In this way, the variation in the lengths of cable cord dispensable from the cord storage and dispensing system is greatly increased. Retainer means may be included to hold the cable cord in place in the receiving track, in the passage between two adjacent projecting blocks and/or at the location immediately preceding the outlet port(s).

BRIEF DESCRIPTION OF DRAWINGS

A more complete understanding of the extension socket with cord storage and dispensing system of this invention and its working may be obtained by reference to the following detailed description when read in conjunction with the accompanying drawings wherein.

DETAILED DESCRIPTION OF INVENTION

The present invention will now be described more fully hereinafter with reference to the accompanying drawings.

Figure 1A:
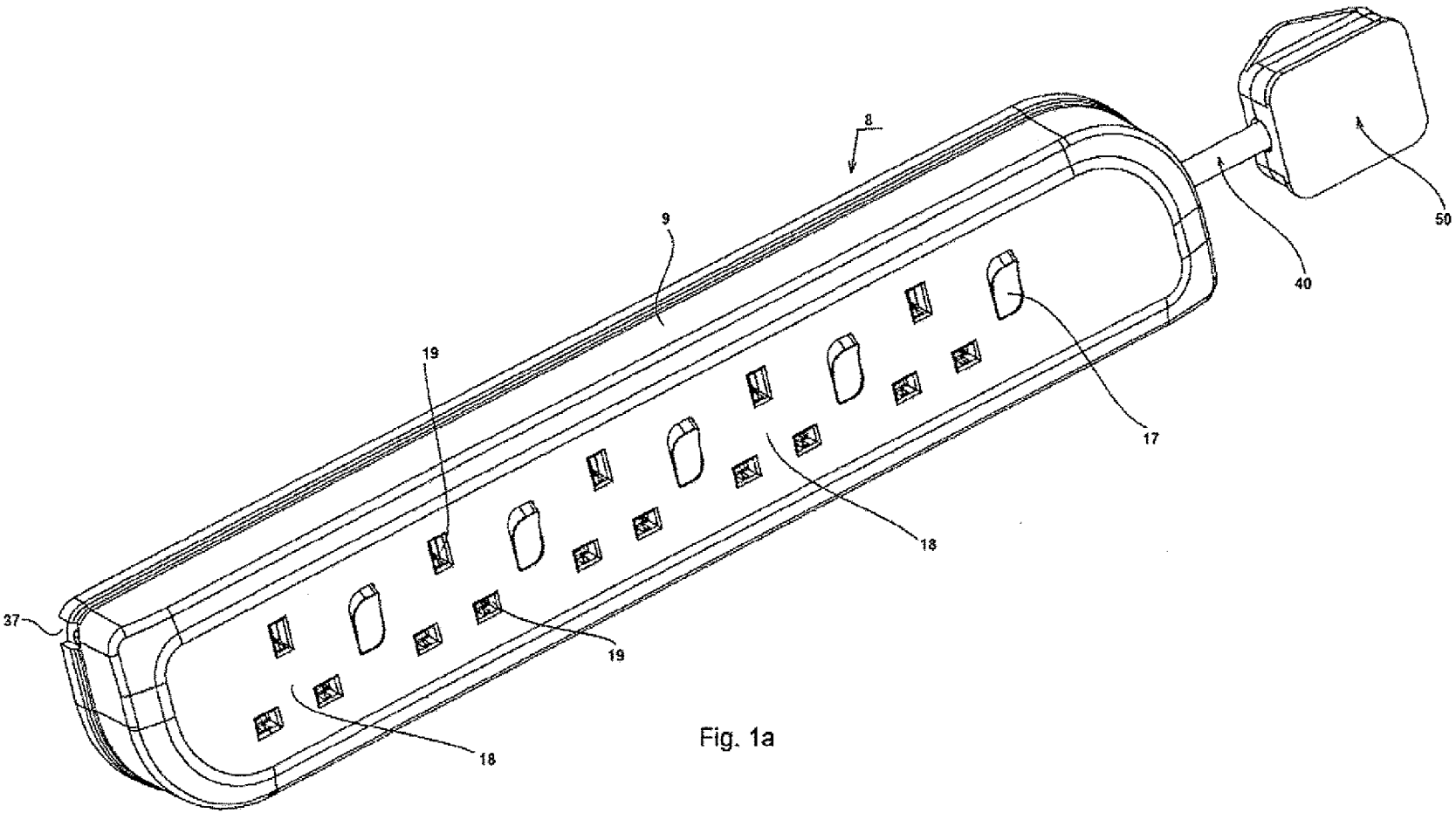
FIG. 1*a* shows a perspective top view of the extension socket of this invention.
Figure 1B:
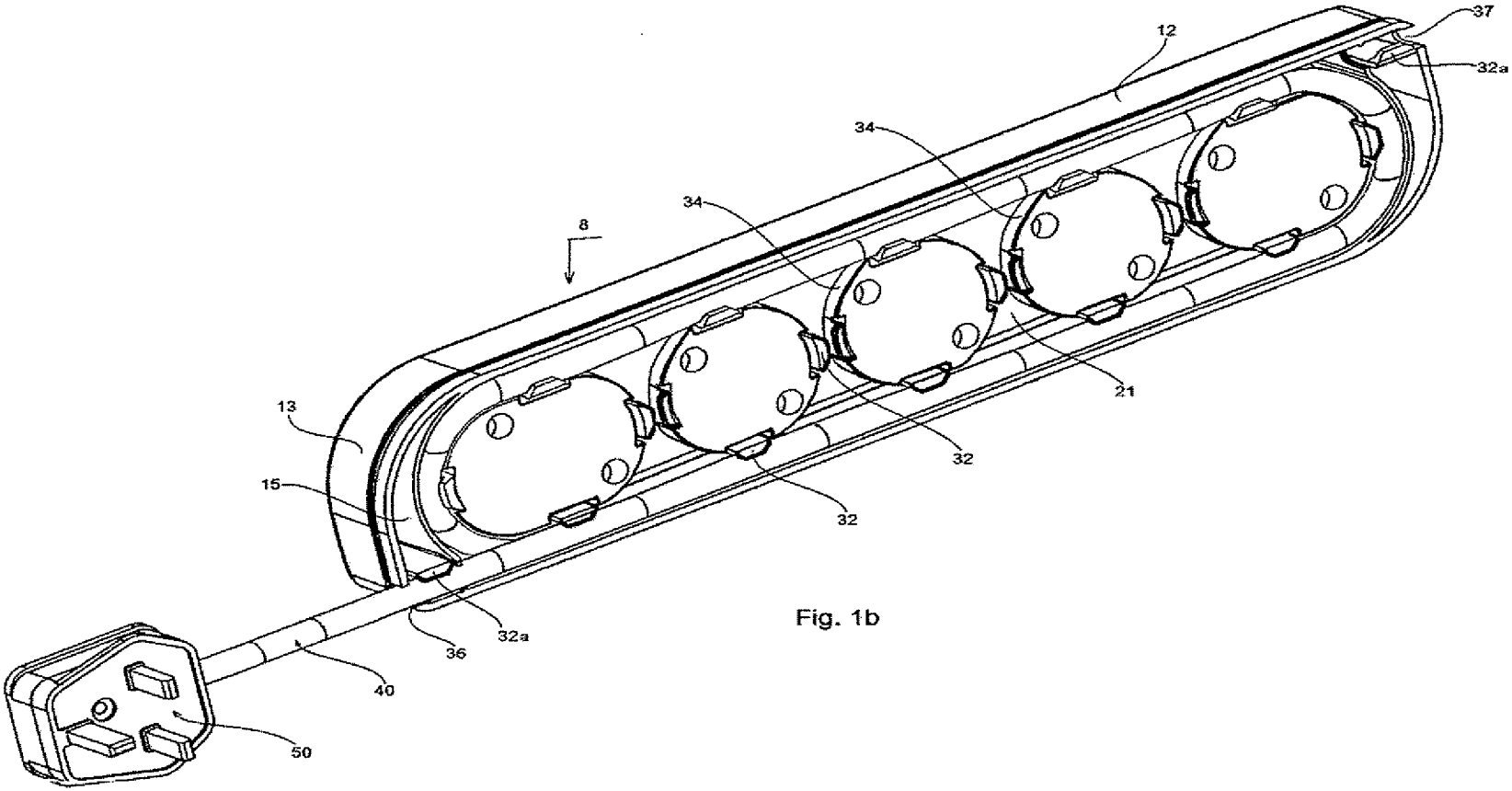
FIG. 1*b* shows a perspective bottom view of the extension socket of FIG. 1.

Referring to FIGS. 1*a* and 1*b*, shown is an extension socket (8) with a row of socket units (18) in an insulative housing (9) to enable power to be supplied from a single power source through respective plugs to a plurality of electrically operated devices. Each socket unit (18) is provided with a switch (17) and the requisite number of apertures (19), the apertures (19) being arranged and shaped to admit a conventional two- or three-pin plug (not shown) by which electrical contact is made with the wiring and contact mechanisms within the housing (9). In conventional manner, for a socket unit (18) with three apertures one of the apertures (19) is to admit the earth pin of a plug.

Figure 2:
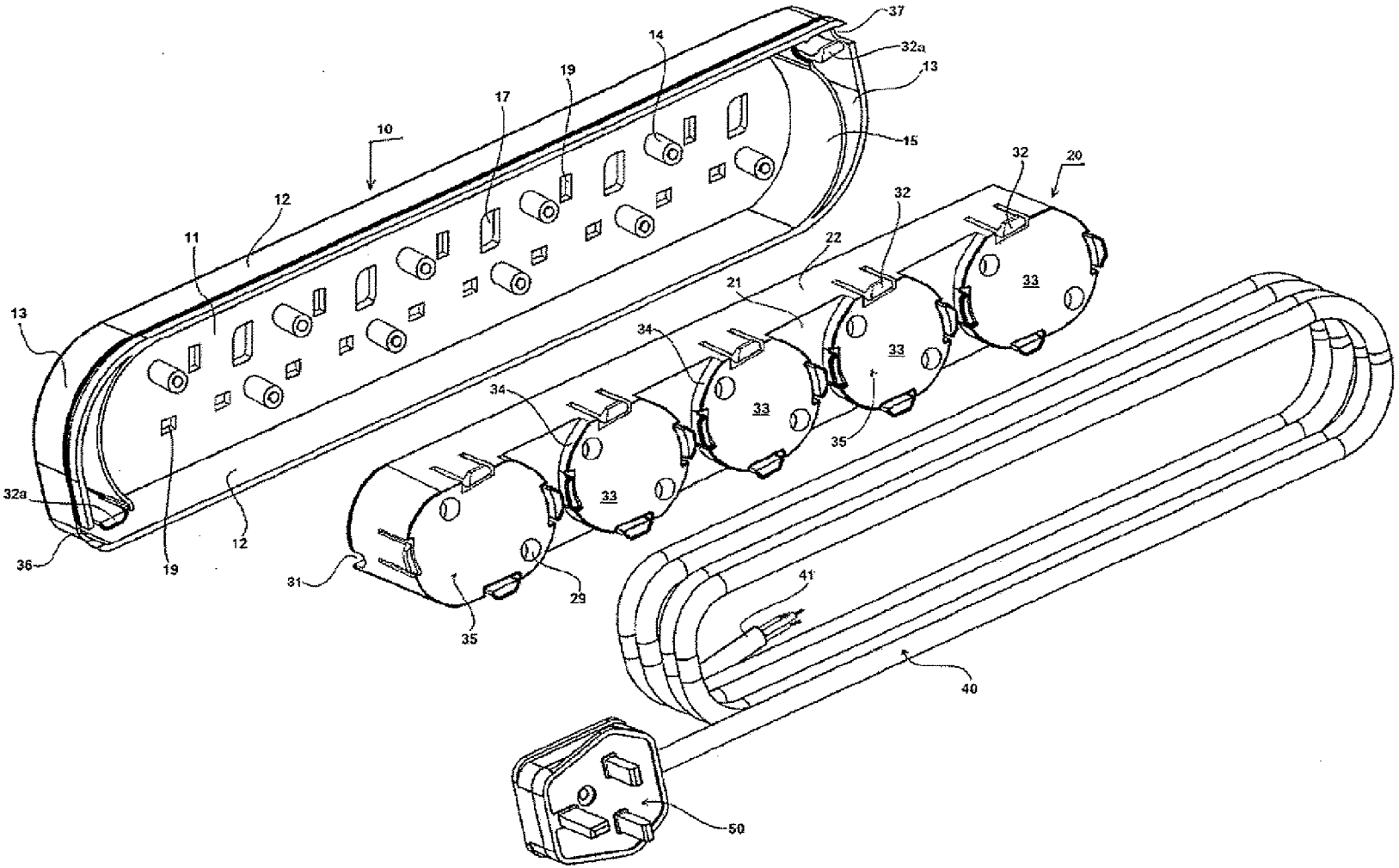
FIG. 2 is a partial exploded view of the extension socket for the purpose of illustrating important features of this invention.

FIG. 2 is a partial exploded view of the extension socket with the wiring and contact mechanisms omitted for the purpose of clarity in illustrating important features of this invention Referring to FIG. 2, the insulative housing (9) comprises a pair of housing halves, the upper housing (10) and the lower housing (20).

The upper housing (10) comprises a top surface plate (11), two side walls (12) and two arcuate end walls (13). One end of the side walls (12) and one end of the end walls (13) are joined to the top surface plate (11), defining an enclosure therein. The top surface plate (11) is provided with a switch (17) and the requisite number of apertures (19) for each socket unit (18). The apertures (19) admit a conventional two- or three-pin plug (not shown). The top surface plate (11) is also provided at the back with a plurality of posts (14) with internal threads to receive fasteners such as screws. Preferably the upper housing (10) is moulded as an integral unit with the side walls (12) and the end walls (13) forming an endless wall.

The lower housing (20) comprises a bottom plate (21) and an endless intermediate wall (22), with one end of the intermediate wall (22) joined, preferably integrally, to the bottom plate (21). The bottom plate (21) has a plurality of spaced apart projecting blocks (33) extending outward from the back of the bottom plate (21). Each projecting block (33) has generally circular or oval cross-sectional shape and has an endless block wall (34) and a block plate (35), with one end of the block wall (34) integrally joined to the block plate (35) and the other end integrally joined to the bottom plate (21). There is a passage (38 FIG. 4*b*) of predetermined width confined between the block walls (34) of any two adjacent spaced apart projecting blocks (33), the passage (38) preferably being sufficiently sized to receive passage preferably of only a single line of cable cord (40) of predetermined length, although the predetermined width could be greater than the diameter of the cable cord (40) may be allowed. In the latter case, the additional space in the passage (38) provides room for fine adjustment of the length of cable cord dispensable out from the outlet port (36, 37). The bottom plate (21) and the intermediate wall (22) define a working enclosure with a working space for the wiring and contact mechanisms of the socket units (18). An exit port (31) made in U-shaped and extended upwardly from one end of the free edge of the intermediate wall (22) is provided for one end (41) of the cable cord (40) to be electrically connected to the wiring and contact mechanisms inside, with the other end of the cable cord (40) connected to an electrical plug (50) adapted to be inserted into an electrical socket such as a wall socket outlet or socket of another extension socket. The number of projecting blocks (33) is preferably equal to the number of socket units (18) but can be more or less than the number of socket units (18).

The upper housing (10) is dimensionally bigger than the lower housing (20) so that when the lower housing (20) and the upper housing (10) are coupled together with fasteners such as screws through fastening openings (29) on the projecting blocks (33) onto the posts (14), a receiving track (30) of predetermined width is confined between the walls (12, 13) of the upper housing (10) and the intermediate wall (22) of the lower housing (20). The receiving track (30) takes the form of an open ring-like trough. The cable cord (40) of predetermined length is wound round the perimeter of the receiving track (20) several times and stored therein. Preferably, the upper housing (10) and the lower housing (20) are so dimensioned that the width of the receiving track (30) has only sufficient space to receive a single file of the cable cord (40) of predetermined length. This helps to restrain the movement of the cable cord (40). However, the extension socket (8) of this invention can be modified to receive more than a single file of the cable cord (40). A first outlet port (36) is formed on one of the arcuate end wall (13) of the upper cover (10) to enable the cable cord (40) to dispense therethrough. A second outlet port (37) may also be provided on the other arcuate end wall (13) and diagonally opposite the first outlet port (36). The upper housing (10) may be further provided with a cable guiding arc (15) each integrally moulded with the respective side walls (13). The cable guiding arc (15) starts on one end of the side wall (12), following the contour of the end section of the intermediate wall (22) and end before the openings of the first and second outlet ports (36, 37) respectively. Preferably, the lower housing (20) is moulded as an integral unit.

Preferably, the combined height of the intermediate wall (22) and the block wall (34) of the projecting blocks (33) of the lower housing (20) is substantially equal to the height of the walls (12, 13) of the upper housing (10).

Figures 3A, 3B, 4A, 4B:
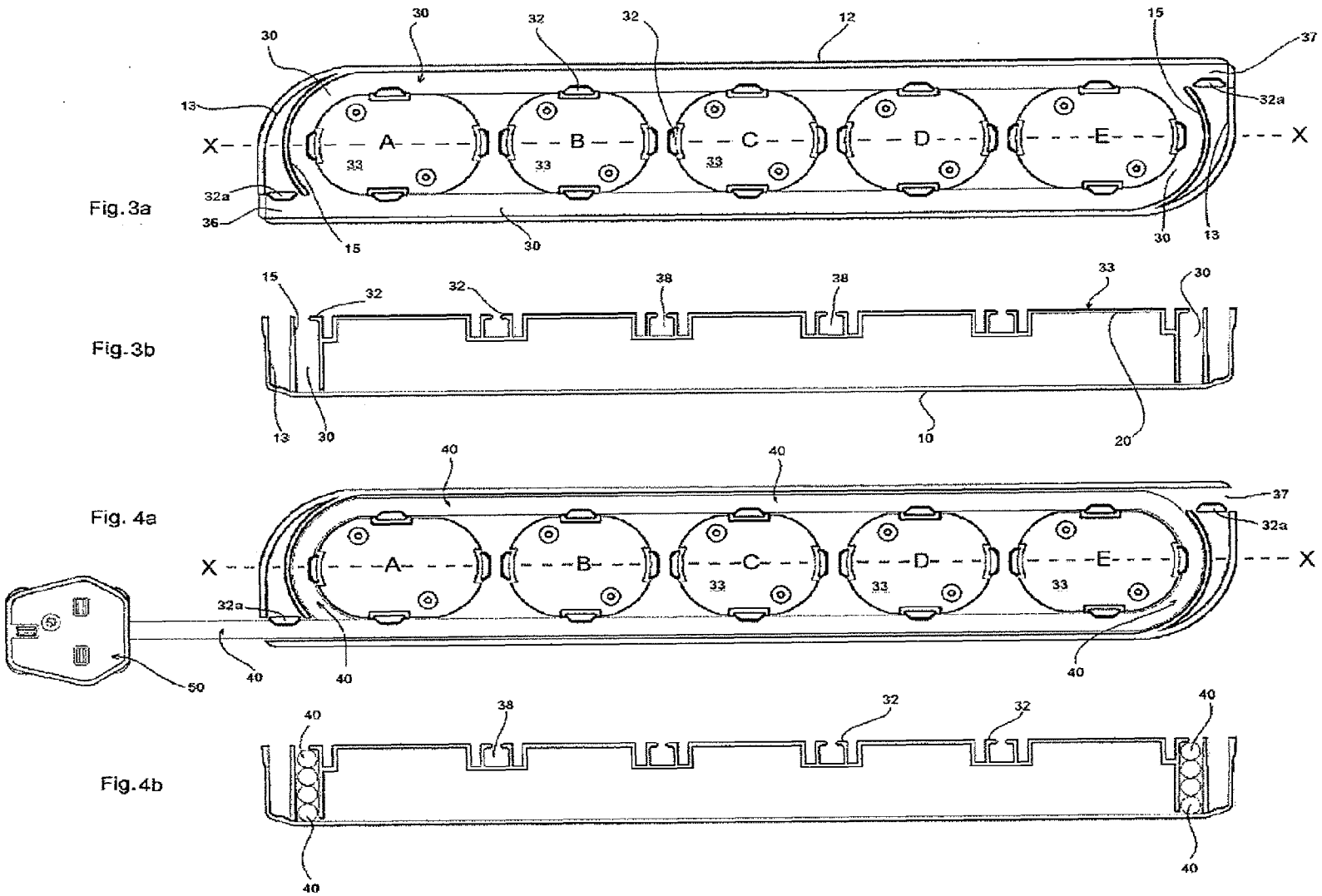
FIG. 3*a* is another view illustrating the receiving track of the of the extension socket by omitting the cable cord in the drawing.
FIG. 3*b* is the cross-sectional view of the extension socket of FIG. 3*a*.
FIG. 4*a* is a bottom view of the extension socket.
FIG. 4*b* is the cross-sectional view of FIG. 4*a* along the line X-X.

At predetermined positions along the edge at the back of the bottom plate (21) of the lower housing (20), there is provided a plurality of flexible retainer means (32). Preferably the retainer means (32) are located at the edge of the intermediate wall (22) tangential to the projecting blocks (33) as shown in FIG. 4*a*. Each retainer means (32) partially covers the opening of the receiving track (30). The retainer means (32) serves to restrain the movement of the cable cords (40) in single file when it is retracted inside the receiving track (30). The retainer means (32) takes the form of an inverted L-shaped element integrally moulded with the lower housing (20). As seen in FIG. 4*b*, a space is also provided between the inverted L-shaped element and the intermediate wall (22). Retainer means (32) may also be provided at the back of the bottom plate (21) at the point where the passage (38) is tangential to the projecting blocks (33). The retainer means (32) at the passage (38) point may have the vertical arm of the inverted L-shaped element shaped to follow the contour of the projecting block (33) at the passage (38) point. Retainer means (32*a*) are also provided at the location immediately preceding each of the outlet ports (36, 37) to hold the cable cord (40) exiting the housing (9) in position. These retainer means (32*a*) rise from the back of the top surface plate (11) of the upper housing (10) and are preferably located between the end of the cable guiding arc (15) and the side wall (13) of the upper housing (10).

The functions of the second outlet port (37) as well as the projecting blocks (33) in relation to the working of the storage and dispensing system of the present invention will be described hereinafter.

Referring to FIGS. 3*a* and 3*b*, the upper housing (10) and the lower housing (20) of the insulative housing (9) of the extension socket (8), when coupled together, confine a receiving track (30) between the walls (12, 13) of the upper housing (10) and the intermediate wall (22) of the lower housing (20). The cable cord (40) has been omitted in FIGS. 3*a* and 3*b* for the purpose of clarity in illustrating the receiving track (30). The cable cord (40) of predetermined length is wound round the perimeter of the receiving track (20) several times. Depending on the predetermined depth of the receiving track (30) according to the design of the invention, predetermined rounds or complete turns of the cable cord (40) are allowed. In FIG. 4*b* four turns of the cable cord (40) are shown retracted in the receiving track (30), one on top of the other in a single file. As described earlier, the width of the receiving track (30), preferably, has sufficient space to receive only a single file of the cable cord (40) of predetermined length but is not necessarily so restricted. Preferably the predetermined length of the cable cord (40) is of a length to enable the cable cord (40) to be substantially fully retracted into the receiving track (30), preferably in a single file.

For an extension socket with only one outlet port as in WO03/088427, the length of cable cord can only be dispensed out from the receiving track (30) of the extension socket in multiple of a full turn around the receiving track. That is, if the length of one turn of cable cord around the receiving track is L, the lengths of cable cord dispensable out from the receiving track will be L, 2L, 3L and 4L for a receiving track having a depth to receive and store four turns of cable cord therein. In the extension socket (8) of this invention, two diagonally opposite outlet ports (36, 37) are provided on the end walls (13) of the upper cover (10), namely the first outlet port (36) and the second outlet port (37). With this, the cable cord (40) can be dispensable out from the receiving track (30) from either of the outlet ports (36, 37). Correspondingly, the lengths of the cable cord (40) dispensable out from the receiving track (30) will be shorter and in multiple of half a turn of cable cord (40) around the receiving track (30). That is, the lengths of cable cord (40) dispensable out from the receiving track (30) will be ½L, L, 1½L, 2L, 2½L, 3L, 3½L and 4L. In this embodiment, the cable cord (40) is shown encircling the receiving track (30) in a clock wise direction. The cable cord (40) can be made to encircle around the receiving track (30) in an anti-clockwise direction by having the outlet ports in another diametrically opposite positions than that shown in any of the drawings (except FIG. 1*a* where the outlet ports are not shown).

Figure 5A:
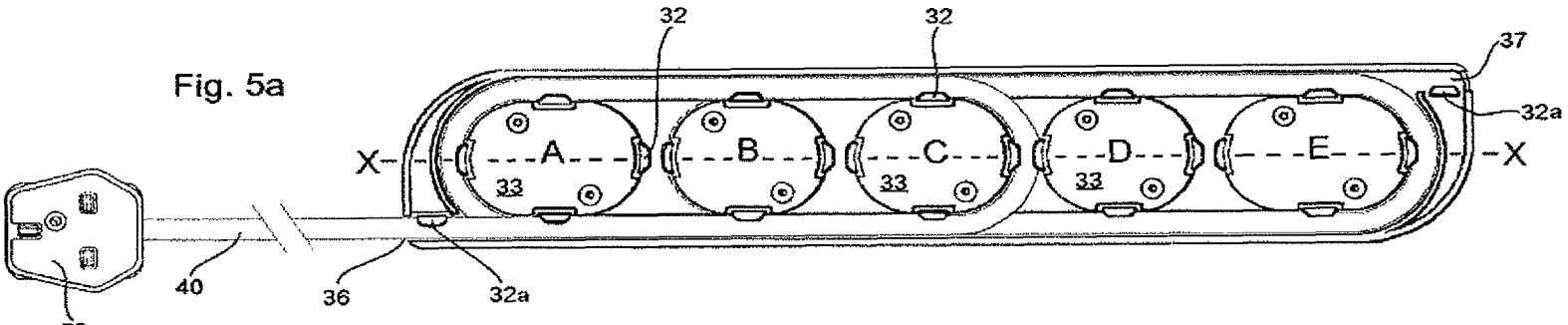
FIG. 5*a* is a bottom view illustrating cable cord looping through a passage between projecting blocks and exiting through a first outlet port.
Figure 5B:
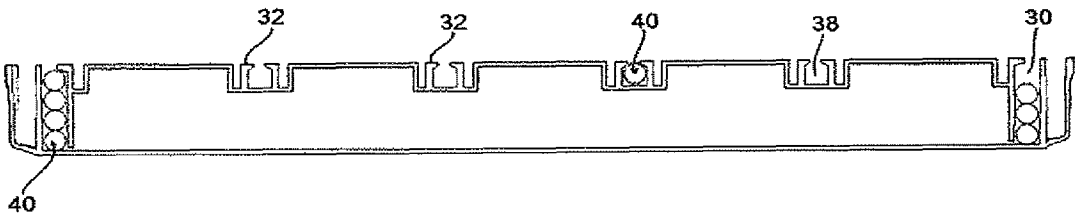
FIG. 5*b* is the cross-sectional view of FIG. 5*a* along the line X-X.
Figure 6A:
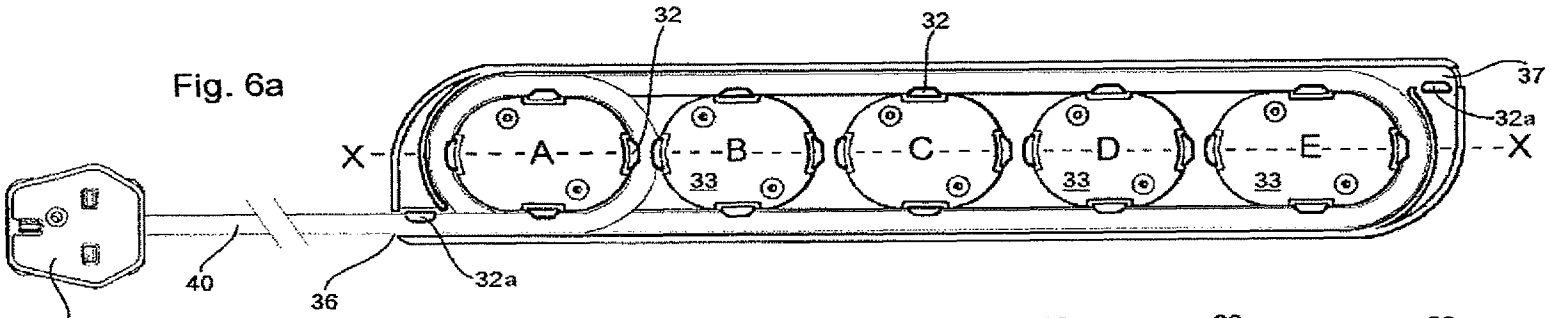
FIG. 6*a* is another bottom view illustrating cable cord half looping through a passage between projecting blocks and exiting through a first outlet port
Figure 6B:
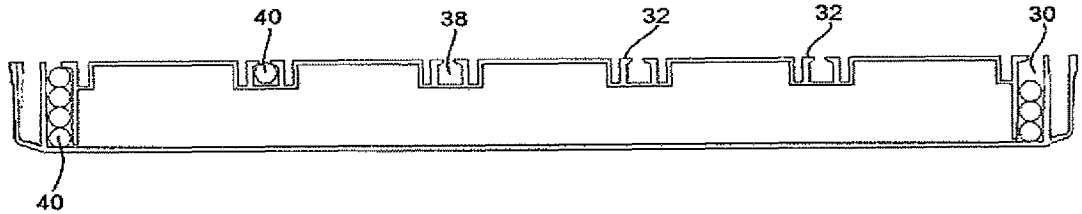
FIG. 6*b* is the cross-sectional view of FIG. 6*a* along the line X-X.

The projecting blocks (33) and the passages (38) there between enable even shorter lengths of cable cord (40) to be dispensable out from the receiving track (30), allowing for a greater variation of and even finer adjustment to the lengths of the cable cord (40) dispensable out from the receiving track (30) as will be explained below. Referring to FIG. 4*b*, it is apparent that the shortest length of the cable cord (40) dispensable out from the receiving track (30) occurs when the first or upper most turn of the cable cord (40) in the receiving rack (30) is made to half loop through the passage (38) between projecting blocks D and E and exiting from the receiving track (30) through the first outlet port (36). Longer lengths can be dispensable out from the receiving track (30) by having the first turn of the cable cord (40) half looping through the passages (38) between projecting blocks C and D, B and C, and A and B respectively in this sequence and all exiting through the first outlet port (36). FIGS. 5*a* and 5*b* shows a situation where the cable cord (40) half loops through the passage (38) between projecting blocks C and D while FIGS. 6*a* and 6*b* illustrates a situation where the cable cord (40) half loops through the passage (38) between projecting blocks A and B.

As mentioned earlier, half a turn of cable cord (40) can be dispensable out from the receiving track (30) by having the half turn of cable cord (40) exiting the receiving track (30) through the second outlet port (37). Take a situation where of a turn of cable cord (40) has been dispensed from the receiving track (30) through the second outlet port (37), when the cable cord (40) half loops through passages (38) between the projecting blocks (33) A and B, or B and C and exiting through the second outlet port (37), the lengths of cable cord (40) dispensable out from the receiving track (30) are longer than half a turn but shorter than one full turn.

Figure 7A:
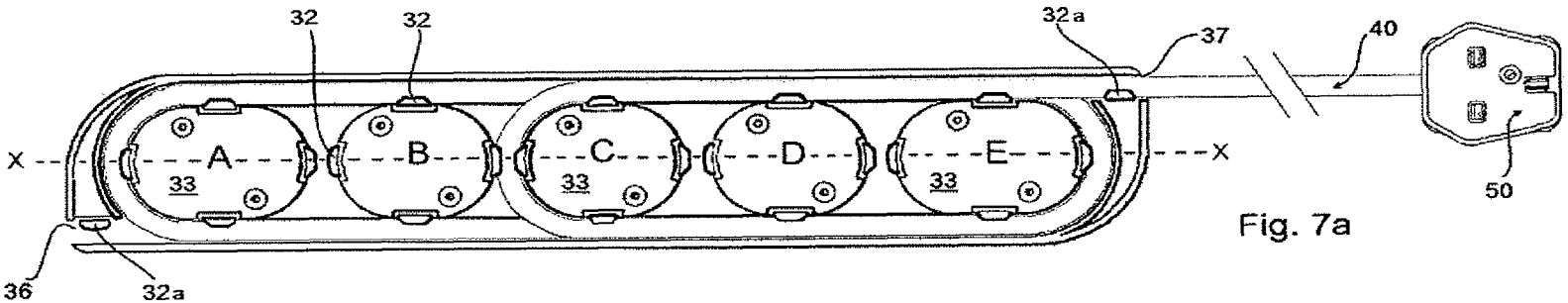
FIG. 7*a* is a bottom view illustrating cable cord half looping through a passage between projecting blocks and exiting through a second outlet port.
Figure 7B:
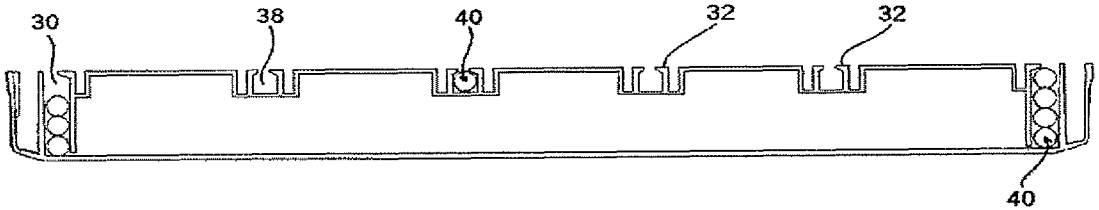
FIG. 7*b* is the cross-sectional view of FIG. 7*a* along the line X-X.
Figure 8A:
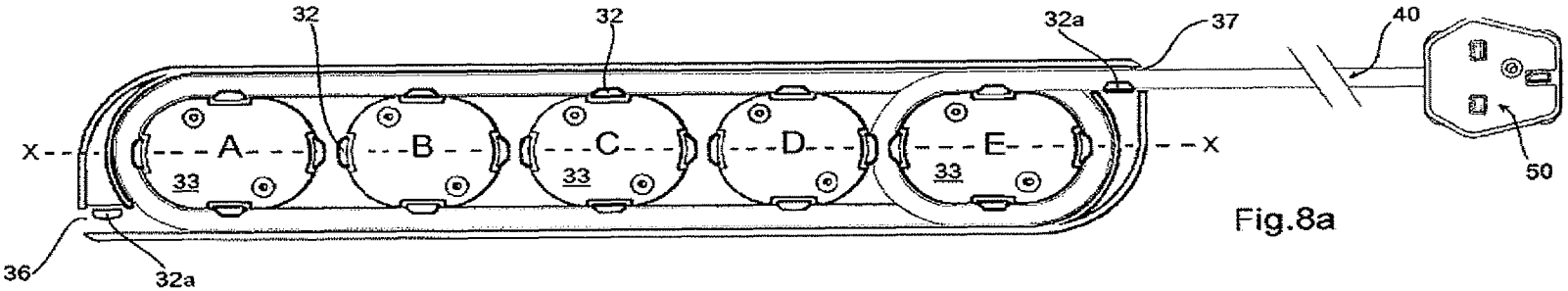
FIG. 8*a* is another bottom view illustrating cable cord half looping through a passage between projecting blocks and exiting through a second outlet port.
Figure 8B:
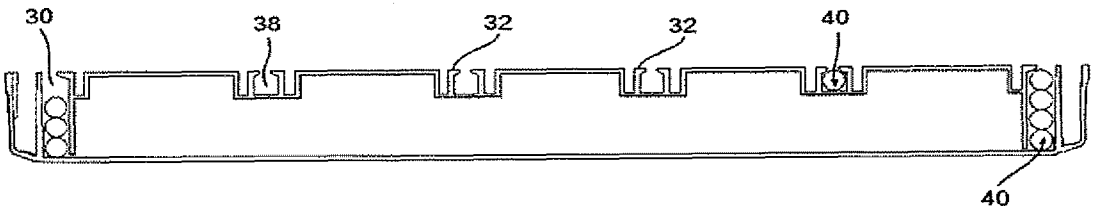
FIG. 8*b* is the cross-sectional view of FIG. 8*a* along the line X-X.

FIGS. 7*a* and 7*b* illustrates a situation where the cable cord (40) half loop through the passage (38) between projecting blocks B and C and exiting through the second outlet port (37), releasing a length of cable cord (40) having a length between half a turn and one turn. FIGS. 8*a* and 8*b* illustrates a situation where the cable cord (40) half loop between projecting blocks D and E and exiting through the second outlet port (37), releasing a length of cable cord (40) from the receiving track (30) having a length between one and a half turn but less than two turns of cable cord (40) around the receiving track (30).

Figures 9A, 9B:
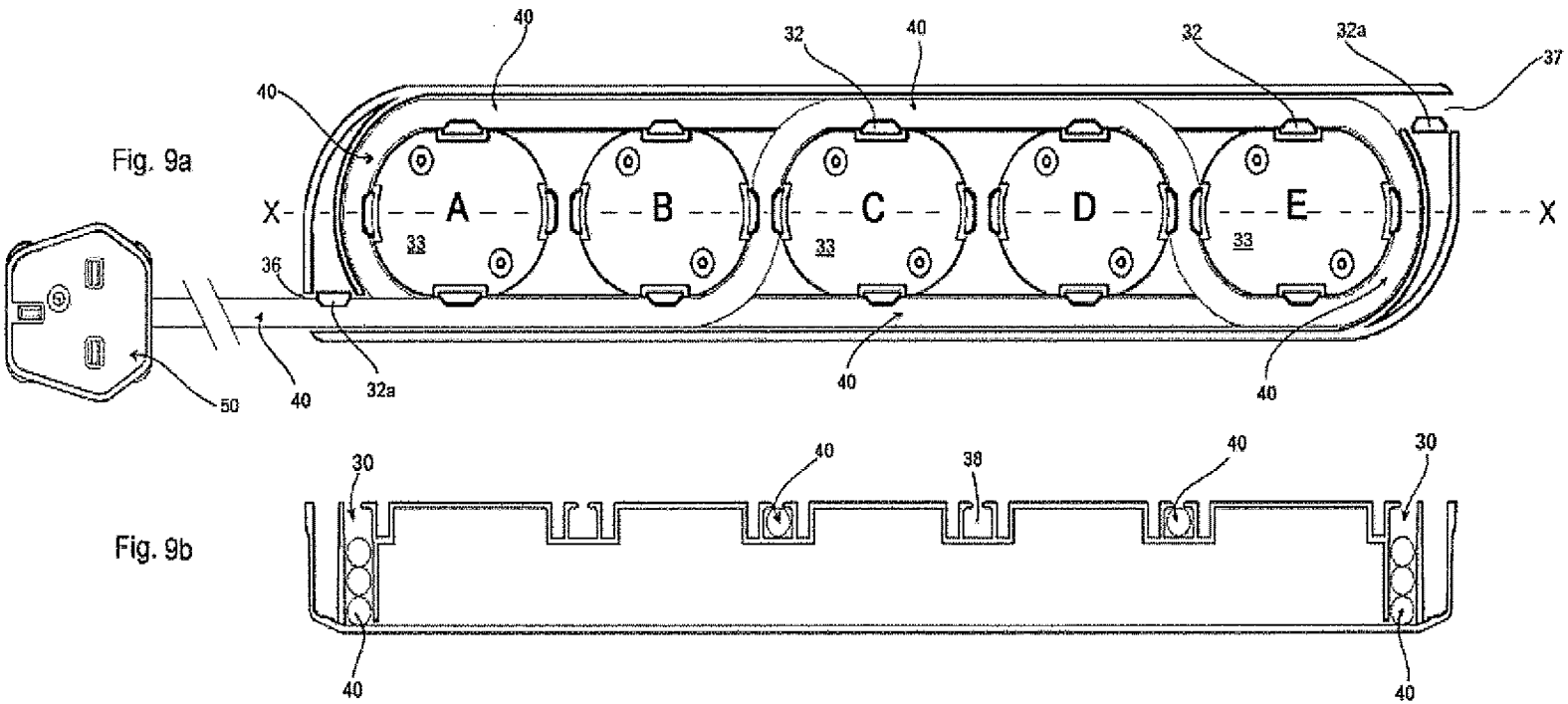
FIG. 9*a* is a bottom view illustrating cable cord sidewinding through two passages between projecting blocks and exiting through a first outlet port.
FIG. 9*b* is the cross-sectional view of FIG. 9*a* along the line X-X.

To achieve finer adjustment to the length of cable cord (40) extendable and dispensable out from the receiving track (30), the cable cord (40) can be made to side wind through two or more passages (38). FIG. 9 shows a situation when the cable cord (40) side wind through two passages (38), the shape of the cable cord (40) formed around the projecting blocks (33) will be that of an undulatory or wavy shape or s-shape. It is apparent that one can half loops and side winds through the passages (38) for greater variations in the lengths of cable cord (40) extendable and dispensable out from the receiving track (30).

The half looping and side winding through passages (38) together with two outlet ports (36, 37) allow finer adjustment in and greater variation in the lengths of cable cord (40) dispensable out from the receiving track (30).

The invention being thus described, it will be obvious that the same may be varied in many ways. Such variations are not to be regarded as a departure from the principle and scope of the invention, and all such modifications as would obvious to a person skilled in the art intended to be included within the scope of following claims.

The invention claimed is:

1. An extension socket (8) with cord storage and dispensing system comprising:

a housing (9), the housing (9) comprising an upper housing (10) and a lower housing (20), the upper housing (10) comprising:

a top surface plate (11) provided with a plurality of socket units (18), two side walls (12) and two end walls (13), with one end of the side walls (12) and another end of the end walls (13) joined to the top surface plate (11);

the lower housing (20) comprising:

a bottom plate (21), and an endless intermediate wall (22), with one end of the intermediate wall (22) joined to the bottom plate (21) defining an enclosure with a space therein;

the upper housing (10) is dimensionally larger than the lower housing (20) so that when the lower housing (20) and the upper housing (10) are coupled and fastened together to form the housing (9), a receiving track (30) of predetermined width is formed between the walls (12, 13) of the upper housing (10) and the intermediate wall (22) of the lower housing (20);

an electrical plug (50); and a cable cord (40) connected to the plug having a predetermined length with one end extending into a space defined by the lower casing (20) and the top surface plate (11) of the upper housing (10) through an exit port (31) on the intermediate wall (22) of the lower housing (20), the cable cord (40) electrically connected to the socket units (18);

wherein each of the end walls (13) of the upper housing (10) has one outlet port (36, 37) to enable the cable cord (40) to be dispensed out from the receiving track (30) from either of the outlet ports (36, 37) in multiple of half a turn of cable cord around the receiving track (30).

2. The extension socket (8) with cord storage and dispensing system as in claim 1 wherein the intermediate wall (22) of the lower housing (20) is provided with a plurality of retainer means (32).

3. The extension socket (8) with cord storage and dispensing system as in claim 1 wherein a retainer means (32*a*) is provided immediately preceding each outlet port (36, 37) to hold the cable cord (40) in position.

4. The extension socket (8) with cord storage and dispensing system as in claim 1 wherein the end walls (13) of the upper housing (10) is further provided with a cable guiding arc (15).

5. The extension socket (8) with cord storage and dispensing system as in claim 1 wherein the upper housing (10) and the lower housing (20) are so dimensioned that the predetermined width of the receiving track (30) has sufficient space to receive a single file of the cable cord (40).

6. An extension socket (8) with cord storage and dispensing system comprising:

a housing (9), the housing (9) comprising an upper housing (10) and a lower housing (20), the upper housing (10) comprising:

a top surface plate (11) provided with a plurality of socket units (18), two side walls (12), and two end walls (13), with one end of the side walls (12) and another end of the end walls (13) joined to the top surface plate (11) to define an enclosure therein, and with one of the end walls (13) having a first outlet port (36);

the lower housing (20) comprising:

a bottom plate (21), and an endless intermediate wall (22), with one end of the intermediate wall (22) joined to the bottom plate (21) defining an enclosure with a space therein;

the upper housing (10) is dimensionally larger than the lower housing (20) so that when the lower housing (20) and the upper housing (10) are coupled and fastened together, a receiving track (30) of predetermined width is formed between the walls (12, 13) of the upper housing (10) and the intermediate wall (22) of the lower housing (20);

an electrical plug (50); and a cable cord (40) connected to the plug having a predetermined length with one end extending into a space defined by the lower casing (20) and the top surface plate (11) of the upper housing (10) through an exit port (31) on the intermediate wall (22) of the lower housing (20), the cable cord (40) electrically connected to the socket units (18);

wherein the bottom plate (21) of the lower housing (20) has a plurality of spaced apart projecting blocks (33) extending outward from a back surface of the bottom plate (21); and wherein a passage (38) of predetermined width, on the lower casing adapted for receiving passage of the cable cord (40), is defined between two adjacent projecting blocks (33), the passage (38) being adapted for finer adjustment to the length of the cable cord (40) dispensable out through the first outlet port (36).

7. The extension socket (8) with cord storage and dispensing system as in claim 6, wherein the other end wall (13) of the upper housing (10) is provided with a second outlet port (37) to enable the cable cord (40) to be dispensed out from the receiving track (30) from either of the outlet ports (36, 37).

8. The extension socket (8) with cord storage and dispensing system as in claim 6 or 7, wherein the back of the bottom plate (21) of the lower housing (20) is provided with a plurality of retainer means (32).

9. The extension socket (8) with cord storage and dispensing system as in claim 8, wherein the plurality of retainer means (32) is provided at the intermediate wall (22) tangential to the projecting blocks (33).

10. The extension socket (8) with cord storage and dispensing system as in claim 6 or 7, wherein at least one retainer means (32) is further provided at the back of the bottom plate (21) at each point where the passage (38) is tangential to the projecting blocks (33).

11. The extension socket (8) with cord storage and dispensing system as in claim 6 or 7, wherein a retainer means (32*a*) is provided immediately preceding the outlet port (36) to hold the cable cord (40) in position.

12. The extension socket (8) with cord storage and dispensing system as in claim 6 or 7, wherein the projecting block has generally circular or oval cross-sectional shape.

13. The extension socket (8) with cord storage and dispensing system as in claim 6 or 7, wherein the predetermined width of the passage (38) is equal or greater than the diameter of the cable cord (40).

14. The extension socket (8) with cord storage and dispensing system as in claim 6 or 7, wherein the combined height of the intermediate wall (22) and the block wall (34) of the projecting blocks (33) is substantially equal to the height of the walls (12, 13) of the upper housing (10).

15. The extension socket (8) with cord storage and dispensing system as in claim 6 or 7, wherein each of the end walls (13) of the upper housing (10) is further provided with a cable guiding arc (15).

16. The extension socket (8) with cord storage and dispensing system as in claim 6 or 7, wherein the number of projecting blocks (33) may or may not equal to the number of socket units (18).

17. The extension socket (8) with cord storage and dispensing system as in claim 6 or 7, wherein the predetermined length of the cable cord (40) is of a length to enable the cable cord (40) to be substantially fully retracted into the receiving track (30).

18. The extension socket (8) with cord storage and dispensing system as in claim 6 or 7, wherein the cable cord (40) may half loop and/or side winding about the projecting blocks (33) through one or more passages (38).

* * * * *